US007764246B2

(12) United States Patent
Yu et al.

(10) Patent No.: US 7,764,246 B2
(45) Date of Patent: Jul. 27, 2010

(54) WIRELESS DEVICE AND METHOD FOR IMPROVING ANTENNA CHARACTERISTIC OF THE WIRELESS DEVICE

(75) Inventors: Chao-Hui Yu, Taipei Hsien (TW); Hung-Jen Chen, Taipei Hsien (TW); Yu-Yuan Wu, Taipei Hsien (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 481 days.

(21) Appl. No.: 11/864,969

(22) Filed: Sep. 29, 2007

(65) Prior Publication Data

US 2009/0085822 A1 Apr. 2, 2009

(51) Int. Cl.
*H01Q 1/52* (2006.01)

(52) U.S. Cl. ..... 343/841; 343/702; 343/872

(58) Field of Classification Search ..... 343/841, 343/702, 872

See application file for complete search history.

(56) References Cited

U.S. PATENT DOCUMENTS 5,394,160 A * 2/1995 Iwasaki et al. ..... 343/702
5,596,487 A * 1/1997 Castaneda et al. ..... 361/814
5,874,920 A * 2/1999 Araki et al. ..... 343/702

* cited by examiner

*Primary Examiner*—Douglas W Owens
*Assistant Examiner*—Dieu Hien T Duong
(74) *Attorney, Agent, or Firm*—WPAT, P.C.; Anthony King

(57) ABSTRACT

A wireless device includes a housing having a shielding case and a dielectric case. The housing receives a printed circuit board and an antenna element. The printed circuit board has a feeding pad, a first ground pad and a second ground pad. The antenna has a feeding portion electronically coupled with the feeding pad of the printed circuit board and a ground portion electronically coupled with the shielding case for increasing ground dimension to improve antenna characteristic. The first and second ground pads of the printed circuit board electronically coupled with the shielding case for reducing coupling effect to improve antenna characteristic.

9 Claims, 5 Drawing Sheets

| | | | | | | |
|---|---|---|---|---|---|---|
| 1 | 2.4000000 | GHz | 50.688 Ω | 30.036 Ω | 1.9920 | NH |
| 2 | 2.4410000 | GHz | 42.556 Ω | 6.5322 Ω | 425.90 | PF |
| 3 | 2.4800000 | GHz | 25.936 Ω | 2.5379 Ω | 162.87 | PF |

| | | | |
|---|---|---|---|
| 1 | 2.4000000 | GHz | 1.8073 |
| 2 | 2.4410000 | GHz | 1.2503 |
| 3 | 2.4800000 | GHz | 1.8974 |

| | | | | | | |
|---|---|---|---|---|---|---|
| 1 | 2.4000000 | GHz | 66.944Ω | 22.480Ω | 11.693 | NH |
| 2 | 2.4410000 | GHz | 43.861Ω | -5.5761Ω | 11.693 | PF |
| 3 | 2.4800000 | GHz | 23.778Ω | -3.7850Ω | 19.955 | PF |

| | | | |
|---|---|---|---|
| 1 | 2.4000000 | GHz | 1.6206 |
| 2 | 2.4410000 | GHz | 1.1823 |
| 3 | 2.4800000 | GHz | 2.1020 |

WIRELESS DEVICE AND METHOD FOR IMPROVING ANTENNA CHARACTERISTIC OF THE WIRELESS DEVICE

BACKGROUND OF THE INVENTION

1. Field of the Invention

The invention relates to a wireless device having preferred antenna characteristic and a method for improving antenna characteristic of the wireless device. More specifically, a method for increasing ground dimension of an antenna element and a printed circuit board to improve antenna characteristic of the wireless device.

2. The Related Art

According to the progress of the communication technology, the key development is the transfer from wired to wireless communication, such as the popularization of the wireless household phones, mobile phones and personal digital assistants. In the field of wireless communication, the signal is carriered through invisible electromagnetic wave. Therefore, the bridge between electrical signal and electromagnetic wave is an antenna. So the antenna is certainly needed by a wireless device to transmit or receive electromagnetic wave. The antenna is therefore an essential component in the wireless device.

Recently, the wireless device is required to be compact, light, and multi-functional according to a recent demand. The antenna, printed circuit boards and electric components built on the printed circuit boards become smaller and more multi-functional in order to satisfy the above requirement. Due to the above requirement, the wireless device has a great denseness in arrangement of the electric components. Therefore, coupling effect between the electric components is accordingly raised.

Please refer to FIG. 7. A conventional wireless device 900 has a shielding housing 90 and an insulation housing 91 coupled to the shielding housing 90 for receiving a printed circuit board 92 and an antenna 94. The printed circuit board 92 has plurality of electric components (not shown in figures). Also, a wireless processor 93 is arranged on the printed circuit board 92.

The antenna 94 with a ground point 95 and a feeding point 96 is arranged close to the surface of the printed circuit board 92. The ground point 95 and the feeding point 96 of the antenna 94 electronically couple with ground and the wireless processor 93 of the printed circuit board 92 respectively. Therefore, the wireless device 900 transmits and receives electromagnetic wave through the antenna 94, and processes signal carried by electromagnetic wave through the wireless processor 93.

Due to the antenna 94 being arranged close to the surface of the printed circuit board 92, coupling effect between the electric components interferes antenna characteristic of the antenna 94, such as impedance, antenna gain and frequency range. Therefore, the antenna gain of the antenna 94 is decreased and impedance of the antenna 94 becomes worst.

SUMMARY OF THE INVENTION

An object of the present invention is to provide a wireless device having a shielding case and a dielectric case combined with the shielding case for receiving a printed circuit board and an antenna element. The printed circuit board has a feeding pad, a first ground pad and a second ground pad. The antenna element has a feeding portion and a ground portion.

The feeding portion of the antenna element electronically couples with the feeding pad of the printed circuit. The ground portion of the antenna element electronically couples with the shielding case for increasing ground dimension. The first ground pad and the second ground pad of the printed circuit board electronically couple with the shielding case through a first conductor and a second conductor respectively for increasing ground dimension.

Another object of the present invention is to provide a method for improving antenna characteristic of the antenna element. The method includes means for providing the feeding pad, the first ground pad and the second ground pad on the printed circuit board; means for providing the antenna element with the feeding portion and the ground portion; and means for providing the shielding case and the dielectric case combined with the shielding case to receive the printed circuit board and the antenna element.

The method also includes means for setting electric connection between the feeding portion of the antenna element and the feeding pad of the printed circuit board; means for setting electric connection between the ground portion of the antenna element and the shielding case; means for setting electric connection between the first ground pad of the printed circuit board and the shielding case; and means for setting the electric connection between the second ground pad of the printed circuit board and the shielding case.

Therefore, antenna characteristic of the antenna element is improved because ground dimension of the antenna element is increased. Also, antenna characteristic of the antenna element is improved and coupling effect is reduced because ground dimension of the printed circuit is increased.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
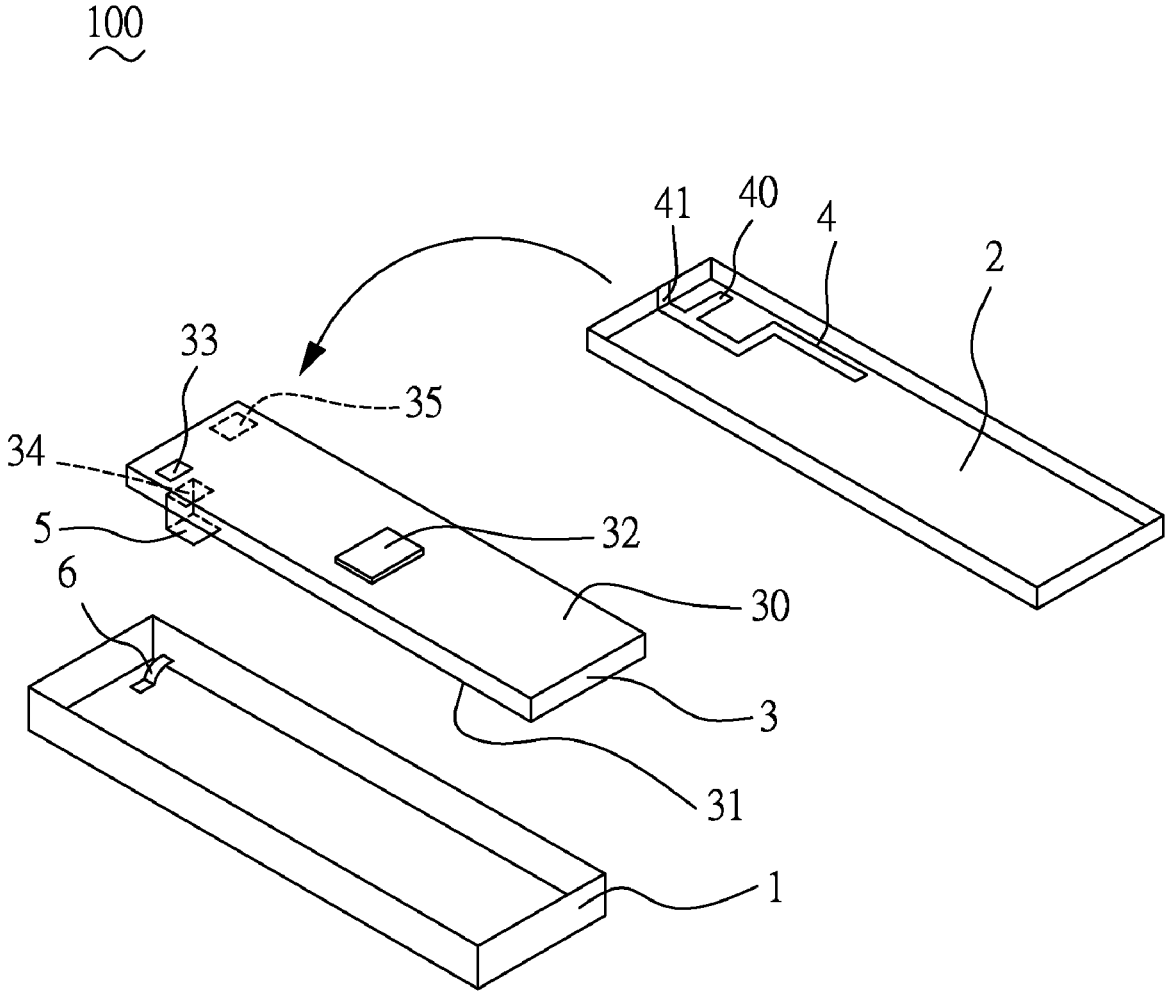
FIG. 1 is an exploded view of a wireless device according to the present invention.

Please refer to FIG. 1. A preferred embodiment of a wireless device 100 according to the present invention is shown. The wireless device 100 has a shielding case 1 made of metal material and a dielectric case 2 made of insulated material. The shielding case 1 and the dielectric case 2 couple to each other for receiving a printed circuit board 3 and an antenna element 4.

The printed circuit board 3 defines a first surface 30 and a second surface 31. Plurality of electric components (not show in figures) are arranged on the first surface 30 and the second surface 31 of the printed circuit board 3. Furthermore, the printed circuit board 3 has a wireless processor 32 and a feeding pad 33 electronically coupled with the wireless processor 32.

In this case, the wireless processor 32 and the feeding pad 33 are arranged on the first surface 30 of the printed circuit board 3. The printed circuit board 3 has a first ground pad 34 and a second ground pad 35 arranged close to the feeding pad 33. In this case, the first ground pad 34 and the second ground pad 35 are arranged on the second surface 31 of the printed circuit board 3.

The antenna element 4 received in the dielectric case 2 has a feeding portion 40 and a ground portion 41. In this case, the antenna element 4 is arranged close to an inner surface of the dielectric case 2. When the wireless device 1 is fabricated, the shielding case 1 combines with the dielectric case 2 to receive the printed circuit board 3 and the antenna element 4.

The first ground pad 34 and the second ground pad 35 of the printed circuit board 3 respectively electronically couple with the shielding case 1 through a first conductor 5 and a second conductor 6 for improving ground dimension of the printed circuit board 3. In this case, the first conductor 5 is a metal piece and the second conductor 6 is a conductive elastomer.

The ground portion 41 extends to outer surface of the dielectric case 2 to electronically couple with the shielding case 1 for improving ground dimension of the antenna element 4. The feeding portion 40 of the antenna element 4 electronically couples with the feeding pad 33 of the printed circuit board 3 for transmitting signal to the wireless processor 32 and receiving signal from the wireless processor 32. In this case, the wireless device 100 is a Bluetooth headset and the antenna element 4 is an inverted-F antenna having a resonance frequency range covering 2.4 GHz.

A method for improving antenna characteristic of the antenna element 4 of the wireless device 100, such as impedance, frequency range and efficiency, includes means for providing the wireless processor 32 and the feeding pad 33 electronically coupled to each other and arranged on the first surface 30 of the printed circuit board 3; means for arranging the first ground pad 34 and the second ground pad 35 to close to the feeding pad 33; and means for providing the antenna element 4 with the feeding portion 40 and the ground portion 41.

The method also includes means for providing the shielding case 1 and the dielectric case 2 combined with the shielding case 1 for receiving the printed circuit board 3 and the antenna element 4; means for setting electric connection between the first and second ground pads 34, 35 of the printed circuit board 3 and the shielding case 1; means for setting electric connection between the ground portion 41 of the antenna element 4 and the shielding case 1; and means for setting electric connection between the feeding pad 33 of the printed circuit board 3 and the ground portion 41 of the antenna element 4.

Figure 2:
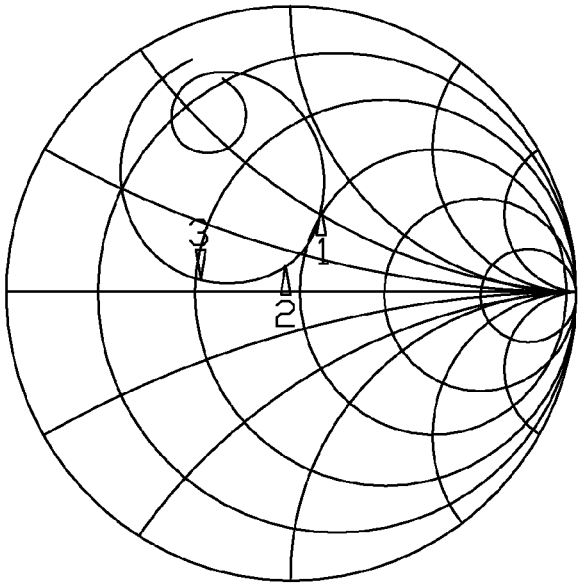
FIG. 2 is a smith chart recording impedance of an antenna element of the wireless device as a function of signal frequency when one of a first ground pad and a second ground pad of a printed circuit board electronically coupling with a shielding case of the wireless device.

Please refer to FIG. 2, which shows a smith chart recording impedance of the antenna element 4 of the wireless device 100 as a function of signal frequency when one of the first ground pad 34 and second ground pad 35 of the printed circuit board 3 electronically coupling with the shielding case 1 of the wireless device 100. The antenna element 4 exhibits an impedance of (50.688+j30.036) Ohm at 2.4 GHz, an impedance of (42.556+j6.5322) Ohm at 2.441 GHz and an impedance of (25.936+j2.5397) at 2.48 GHz. Therefore, impedance of the antenna element 4 very matches 50 Ohm between 2.4 GHz and 2.48 GHz.

Figure 3:
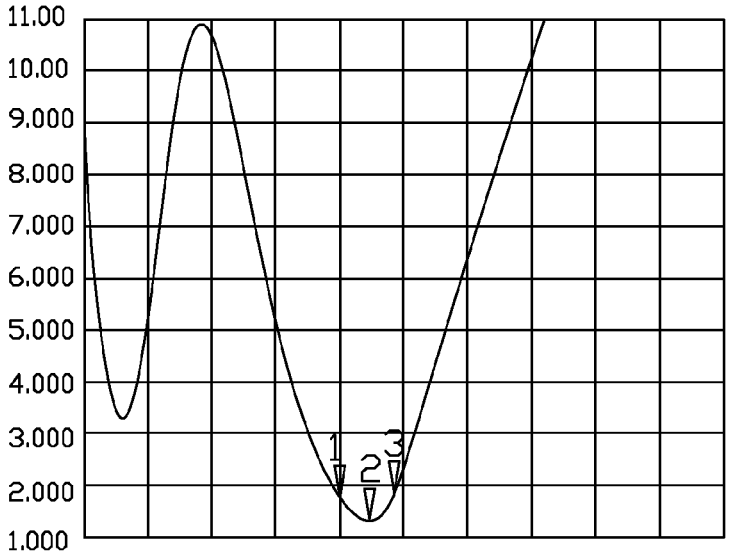
FIG. 3 shows a Voltage Standing Wave Ratio (VSWR) test chart of the antenna element of the wireless device when one of the first ground pad and the second ground pad of the printed circuit board electronically coupling with the shielding case of the wireless device.

Please refer to FIG. 3, which shows a Voltage Standing Wave Ratio (VSWR) test chart of the antenna element 4 of the wireless device 100 when one of the first ground pad 34 and second ground pad 35 of the printed circuit board 3 electronically coupling with the shielding case 1 of the wireless device 100. When the antenna element 4 operates at 2.4 GHz, the VSWR value is 1.8073. When the antenna element 4 operates at 2.441 GHz, the VSWR value is 1.2503. When the antenna element 4 operates at 2.48 GHz, the VSWR value is 1.8974. Therefore, antenna element 4 has preferred frequency response between 2.4 GHz and 2.48 GHz.

Figure 4:
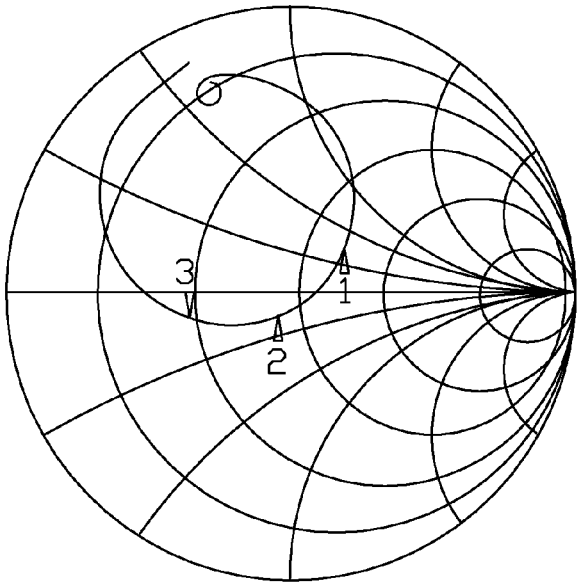
FIG. 4 is a smith chart recording impedance of the antenna element of the wireless device as a function of signal frequency when the first ground pad and the second ground pad of the printed circuit board electronically coupling with the shielding case of the wireless device.

Please refer to FIG. 4, which shows a smith chart recording impedance of the antenna element 4 of the wireless device 100 as a function of signal frequency when the first ground pad 34 and second ground pad 35 of the printed circuit board 3 electronically coupling with the shielding case 1 of the wireless device 100. The antenna element 4 exhibits an impedance of (66.944+j22.48) Ohm at 2.4 GHz, an impedance of (43.861−j5.5761) Ohm at 2.441 GHz and an impedance of (23.778−j3.785) at 2.48 GHz. Therefore, impedance of the antenna element 4 very matches 50 Ohm between 2.4 GHz and 2.48 GHz.

Figure 5:
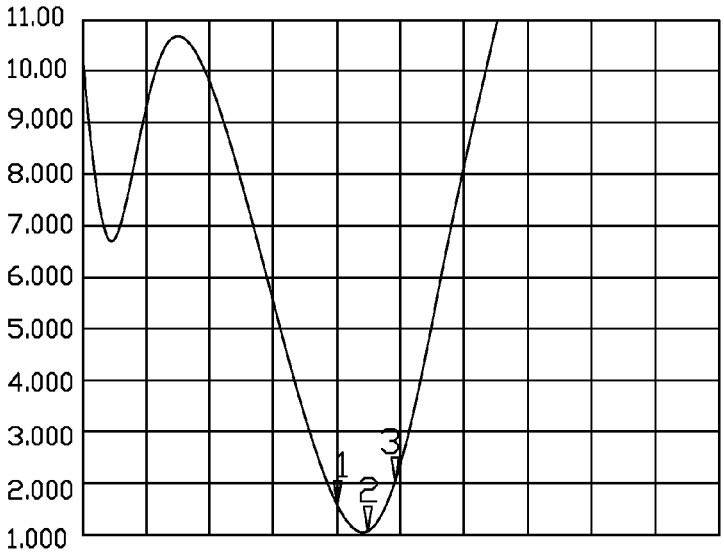
FIG. 5 shows a Voltage Standing Wave Ratio (VSWR) test chart of the antenna element of the wireless device when the first ground pad and the second ground pad of the printed circuit board electronically coupling with the shielding case of the wireless device.

Please refer to FIG. 5, which shows a Voltage Standing Wave Ratio (VSWR) test chart of the antenna element 4 of the wireless device 100 when the first ground pad 34 and second ground pad 35 of the printed circuit board 3 electronically coupling with the shielding case 1 of the wireless device 100. When the antenna element 4 operates at 2.4 GHz, the VSWR value is 1.6206. When the antenna element 4 operates at 2.441 GHz, the VSWR value is 1.1823. When the antenna element 4 operates at 2.48 GHz, the VSWR value is 2.1020. Therefore, antenna element 4 has preferred frequency response between 2.4 GHz and 2.48 GHz.

Figure 6:
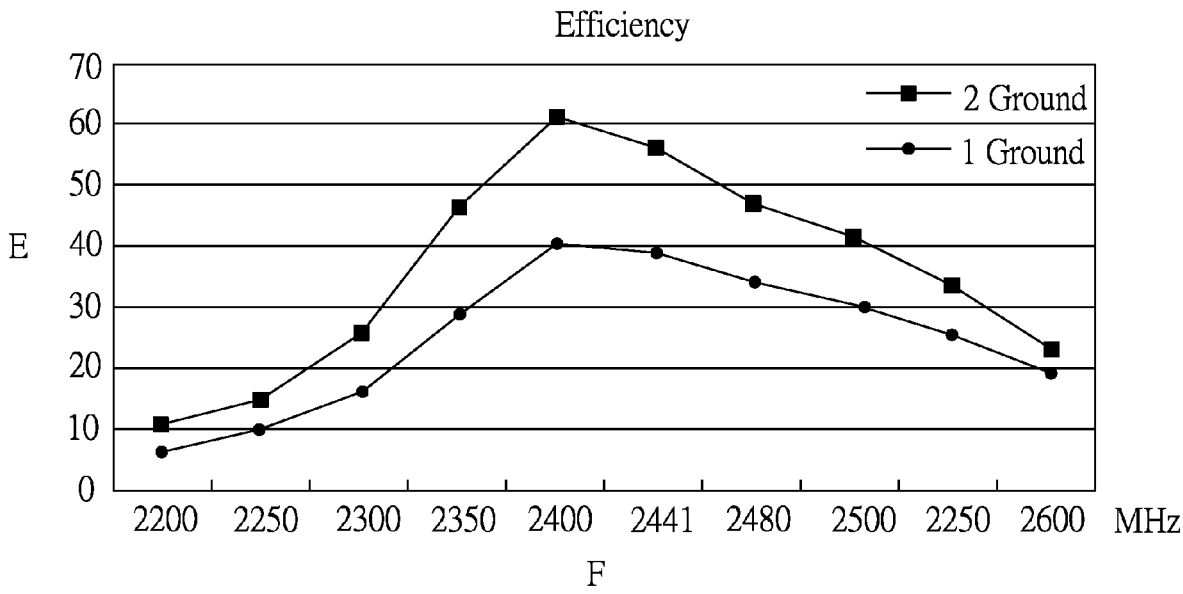
FIG. 6 is a graph showing the efficiency E against frequency F in MHz for the antenna element of the wireless device.
Figure 7:
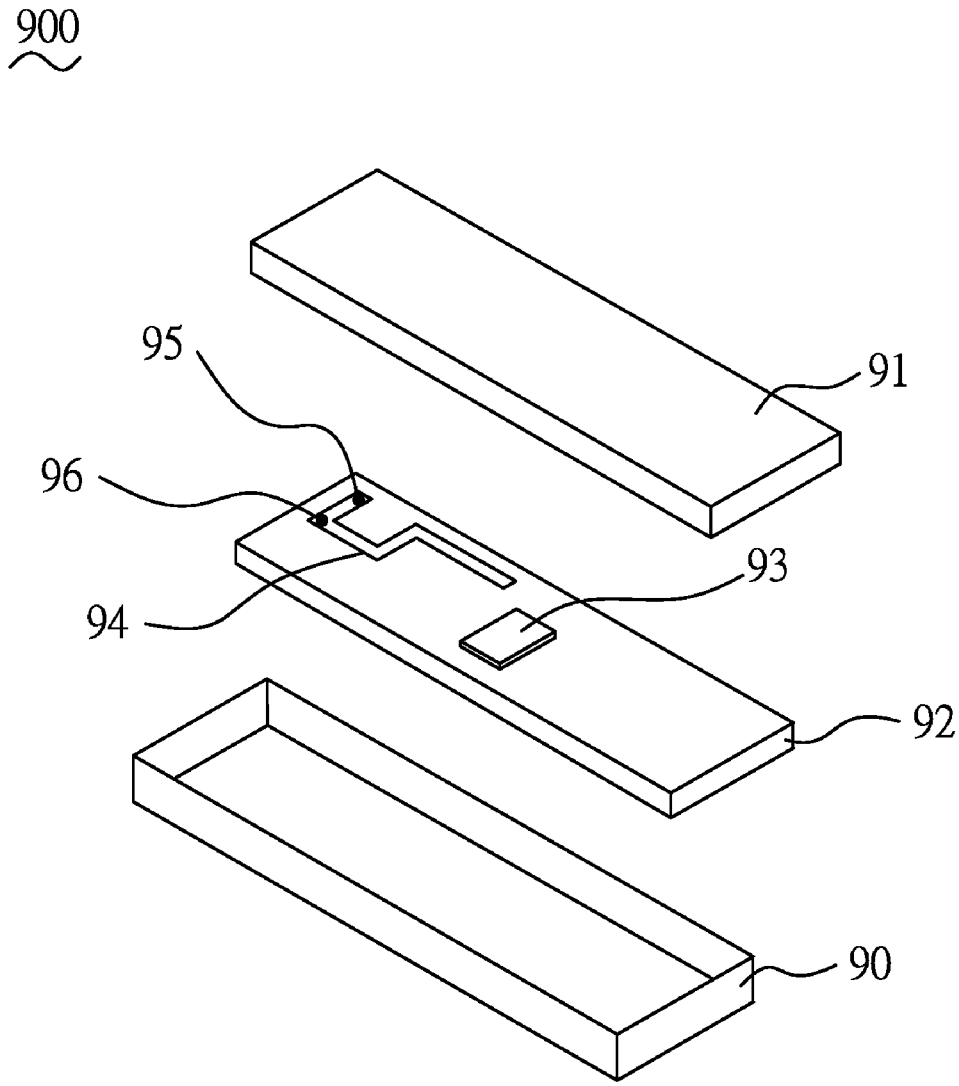
FIG. 7 (Prior Art)
FIG. 7 is an exploded view showing a conventional wireless device.

Please refer to FIG. 6, which shows the efficiency E against frequency F in MHz for the antenna element 4 of the wireless device. When one of the first ground pad 34 and second ground pad 35 of the printed circuit board 3 electronically coupling with the shielding case 1 of the wireless device 100, the efficiency is between 33 percentage and 41 percentage.

When the first ground pad 34 and second ground pad 35 of the printed circuit board 3 electronically coupling with the shielding case 1 of the wireless device 100, the efficiency is between 46 percentage and 62 percentage. Therefore, the antenna element 4 has a preferred efficiency when the first ground pad 34 and second ground pad 35 of the printed circuit board 3 electronically coupling with the shielding case 1 of the wireless device 100.

The ground portion 41 of the antenna element 4 electronically couples with the shielding case 1 for increasing ground dimension to improve antenna characteristic of the antenna element 4. The first ground pad 34 and the second ground pad 35 electronically couple with the shielding case 1, and are arranged close to the feeding pad 33 for increasing ground dimension and reducing coupling effect of the printed circuit board to improve antenna characteristic of the antenna element 4.

Furthermore, the present invention is not limited to the embodiments described above; various additions, alterations and the like may be made within the scope of the present invention by a person skilled in the art. For example, respective embodiments may be appropriately combined.

What is claimed is:

1. A wireless device, comprising:

a shielding case;

a dielectric case combined with said shielding case;

a printed circuit board received in said shielding case and said dielectric case, which has a wireless processor electronically coupled with a feeding pad, a first ground pad and a second ground pad;

an antenna element received in said shielding case and said dielectric case and having a feeding portion and a ground portion electronically coupled with said shielding case;

a first conductor electronically coupled with said first ground pad of said printed circuit board and said shielding case; and a second conductor electronically coupled with said second ground pad of said printed circuit board and said shielding case;

wherein said printed circuit board defines a first surface and a second surface opposite to said first surface, said feeding pad is arranged on said first surface, said first ground pad and said second ground pad are arranged on said second surface.

2. The wireless device as claimed in claim 1, wherein said first ground pad and said second ground pad are arranged close to said feeding pad.

3. The wireless device as claimed in claim 1, wherein said antenna element is arranged close to inner surface of said dielectric case.

4. The wireless device as claimed in claim 3, wherein said ground portion of said antenna element extends to outer surface of said dielectric element.

5. The wireless device as claimed in claim 1, wherein said first conductor is a metal piece.

6. The wireless device as claimed in claim 1, wherein said second conductor is a conductive elastomer.

7. A method for improving antenna characteristic of an antenna element which is received in a housing of a wireless device assembled from a shielding case and a dielectric case, comprising:

providing a feeding pad on a printed circuit board received in said housing;

providing a first ground pad and a second ground pad on said printed circuit board; providing said antenna element with a feeding portion and a ground portion;

setting electric connection between said feeding portion of said antenna element and said feeding pad of said printed circuit board;

setting electric connection between said ground portion of said antenna element and said shielding case;

setting electric connection between said first ground pad and said shielding case; and setting electric connection between said second ground pad and said shielding case;

setting said printed circuit board to have a first surface with said feeding pad and a second surface with said first ground pad and said second ground pad.

8. The method for improving antenna characteristic as claimed in claim 7, further comprising arranging said first ground pad and said second ground pad to close to said feeding pad.

9. The method for improving antenna characteristic as claimed in claim 7, further comprising arranging said antenna element to close to inner surface of said dielectric case.

* * * * *